US005600868A

United States Patent [19]

Tourville et al.

[11] Patent Number: 5,600,868

[45] Date of Patent: Feb. 11, 1997

[54] DEPLOYMENT HINGE

[75] Inventors: Thomas Tourville; George Romich, both of Goleta, Calif.

[73] Assignee: Santa Barbara Research Center, Goleta, Calif.

[21] Appl. No.: 400,164

[22] Filed: Mar. 7, 1995

[51] Int. Cl.[6] ..... E05D 7/00

[52] U.S. Cl. ..... 16/277; 16/280; 16/285; 16/312; 16/357

[58] Field of Search ..... 16/277, 280, 284, 16/285, 303, 312, 313, 315, 357, 360; 244/173

[56] References Cited

U.S. PATENT DOCUMENTS

| | | | |
|---|---|---|---|
| 1,655,043 | 1/1928 | Blackwell | 16/284 |
| 3,620,846 | 11/1971 | Valentijn | 136/89 |
| 3,894,571 | 7/1975 | Hinchliff | 160/201 |
| 3,975,794 | 8/1976 | Kaiser et al. | 16/303 |
| 4,921,506 | 5/1990 | Poulton | 24/67.1 |
| 4,951,351 | 8/1990 | Eckel | 16/303 |
| 5,040,268 | 8/1991 | Knurr | 16/285 |
| 5,193,234 | 3/1993 | Joaquin | 5/99.1 |
| 5,319,905 | 6/1994 | Szirtes | 52/108 |

*Primary Examiner*—M. Rachuba
*Assistant Examiner*—Christopher Kirkman
*Attorney, Agent, or Firm*—W. C. Schubert; W. K. Denson-Low

[57] ABSTRACT

A hinge (20) includes two hinge plates (22, 24) and a connecting hinge pin (32). A coil spring (48) supported on a bushing (44) overlies the hinge pin (32), which is free to move along its longitudinal axis (30). A cam follower (42) on the hinge pin (32) engages a cam (32) mounted to one of the hinge plates (22), so that the hinge pin (32) slides longitudinally as the hinge plates (22, 24) pivot relative to each other about the hinge pin (32). As the hinge pin (32) slides longitudinally, it axially compresses or decompresses the spring (48). The cam (32) is oriented such that pivoting of the hinge plates (22, 24) in either direction from an open position compresses the spring (48), providing a restoring force which tends to retain the hinge plates (22, 24) in the open position.

13 Claims, 3 Drawing Sheets

DEPLOYMENT HINGE

This invention was made with Government Support under Contract No. NAS5-32044 awarded by NASA. The Government has certain rights in this invention.

BACKGROUND OF THE INVENTION

This invention relates to hinges, and, more particularly, to a hinge that is driven from a closed to an open position and resiliently biased toward the open position.

A hinge is a type of flexible joint that permits two pieces to pivot with respect to each other about a pivoting axis. The hinge typically includes two hinge plates, one joined to each piece, and a hinge pin that defines the axis about which the pieces pivot. Hinges are widely used for many applications.

In one specialty application, hinges pivotably join a deployable part such as a solar panel to a relatively fixed part such as a spacecraft. The deployable part is held in a closed, stowed position initially. Upon command in a zero-gravity environment, the deployable part is pivoted to an open, deployed position by pivoting about the hinge pin. The hinge can be relatively small and light, because it operates in the zero-gravity environment. However, the deployable part can have a large mass supported at the end of a long arm, resulting in a large kinetic energy during deployment. When the deployable part reaches its open position, the movement must be halted and the kinetic energy dissipated without damaging the deployable part or overstressing the hinges. Because the deployable part and hinges are designed for use in zero gravity, they typically are relatively fragile structures, and an abrupt stopping can potentially damage them.

It has been conventional practice to use a hard stop and damper and, optionally, a latch to halt the motion of the deployable part when it reaches the open position. While operable, these structures have shortcomings. The hard stop and damper by itself does not hold the deployable part in the open position. The latch holds the deployable part fast, but it has no resiliency to damp out externally imposed loadings that may be imposed upon the deployable part during service.

There is therefore a need for an improved structure for use in supporting and deploying structures, particularly in zero gravity. The present invention fulfills this need, and further provides related advantages.

SUMMARY OF THE INVENTION

The present invention provides a deployment hinge that is advantageously employed in applications wherein a deployable structure is to be deployed from a fixed structure in zero gravity. The deployment hinge is a light weight, smoothly functioning hinge element that supplies a driving force to move the deployable structure from the closed to the open position. Additionally, it supplies a restoring force that biases the deployable part toward the proper deployed position when it is displaced away from that position. The deployment hinge thus aids in dissipating the energy of the deployable part as it reaches the open position and also helps to absorb the energy of loadings and shocks imposed upon the deployable part after deployment.

In accordance with the invention, a hinge system comprises a first hinge having a first hinge plate with a first hinge plate hinge pin receiver thereon, a second hinge plate with a second hinge plate hinge pin receiver thereon, and a cylindrical hinge pin extending between the first hinge plate hinge pin receiver and the second hinge plate hinge pin receiver to pivotably join the first hinge plate and the second hinge plate. The hinge pin has a hinge pin axis coincident with a cylindrical axis of the hinge pin and about which the second hinge plate is pivotable with respect to the first hinge plate. The hinge pin is free to move in a direction parallel to the hinge pin axis relative to the second hinge plate. A coil spring overlies the hinge pin. The hinge further includes means for compressing the spring axially to store energy as the second hinge plate moves from an open position to a closed position and for releasing the stored energy as the second hinge plate moves from the closed position to the open position.

In one embodiment, a hinge system comprises a first hinge having a first hinge plate with a first hinge plate hinge pin receiver thereon, a second hinge plate with a second hinge plate hinge pin receiver thereon, and a cylindrical hinge pin extending between the first hinge plate hinge pin receiver and the second hinge plate hinge pin receiver to pivotably join the first hinge plate and the second hinge plate. The hinge pin has a hinge pin axis coincident with a cylindrical axis of the hinge pin and about which the second hinge plate is pivotable with respect to the first hinge plate. The hinge pin is free to move in a direction parallel to the hinge pin axis relative to the second hinge plate. A cam is supported on the first hinge plate and has a cam surface thereon. A cam follower pin extends outwardly from the hinge pin transversely to the axis of the hinge pin and is disposed to ride on the cam surface. A bushing is fixed to the second hinge plate and overlies the hinge pin. The bushing has a slot therein extending parallel to the axis of the hinge pin. A coil spring overlies the bushing and has a first end fixed with respect to movement parallel to the hinge pin axis. A spring driver pin extends outwardly from the hinge pin transversely to the axis of the hinge pin and through the slot of the bushing, the spring driver pin being disposed to contact a second end of tile spring.

The deployable part, in this case attached to the second hinge plate, is moved to the closed, stowed position against the spring force generated as the cam follower slides along the cam surface. The deployable part is latched at the closed position, during the launching of the spacecraft in the preferred application. At the time of deployment, the latch is released and the spring force biases the second hinge plate and deployable part toward the open, deployed position. As the second hinge plate and deployable part reach the desired open position, their momentum carries them past that position. The camming action compresses the spring, and forces the deployable part back toward the open position. Energy is frictionally dissipated during this movement. Multiple oscillations can occur, but typically only one or two oscillations will be sufficient to damp the energy entirely. The restoring force thus helps to damp out the kinetic energy in the system and position the deployable part. Later, if external forces, impacts, or shocks are imposed upon the deployable part, this same damping action aids in avoiding damage to either the hinge or the deployable part.

The deployment hinge system is relatively light in weight, yet achieves a controlled deployment while minimizing the possibility of damage to the system. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
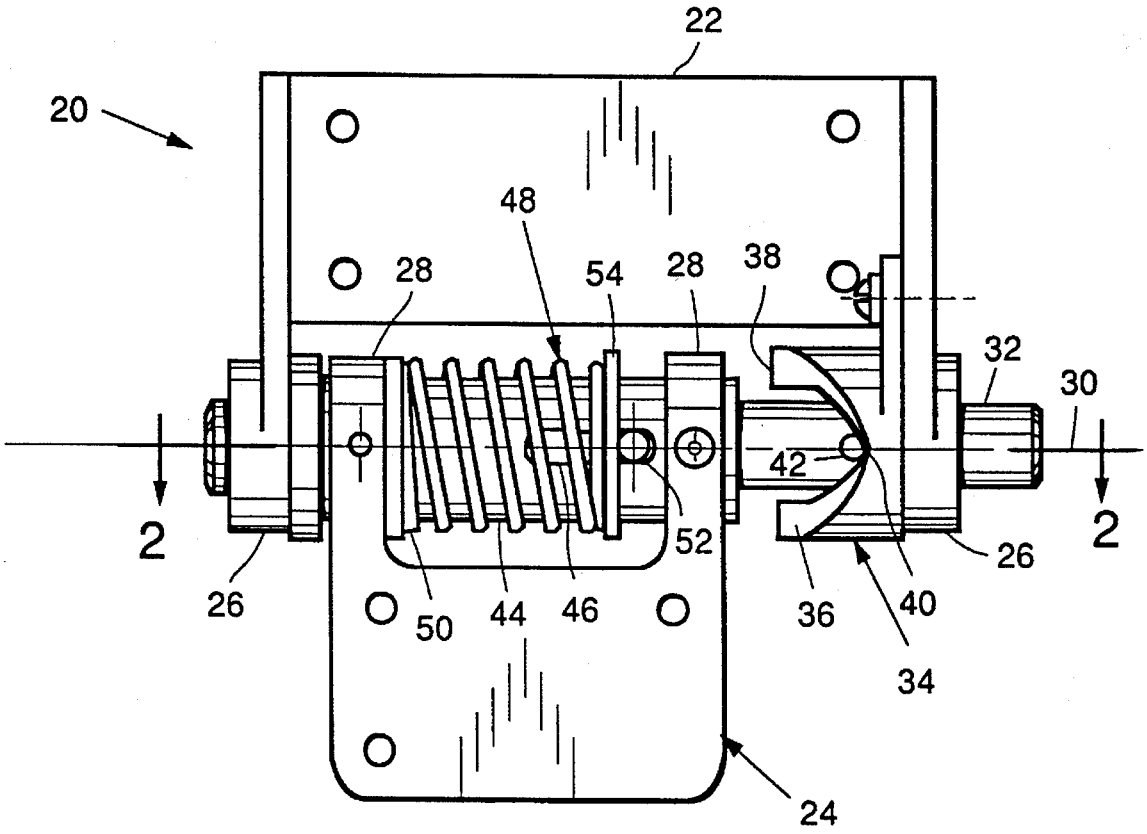
FIG. 1 is a plan view of a deployment hinge in the open position.
Figure 2:
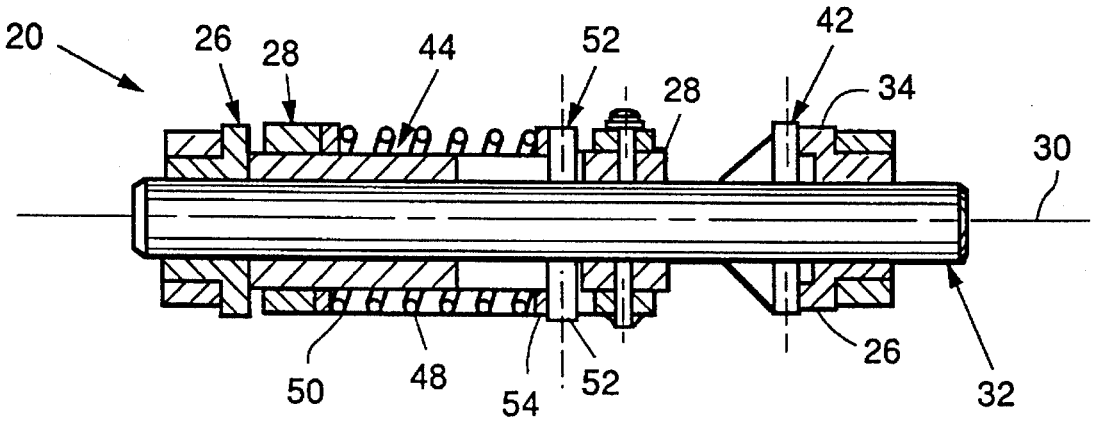
FIG. 2 is a sectional view of the hinge of FIG. 1, taken along line 2—2.
Figure 3:
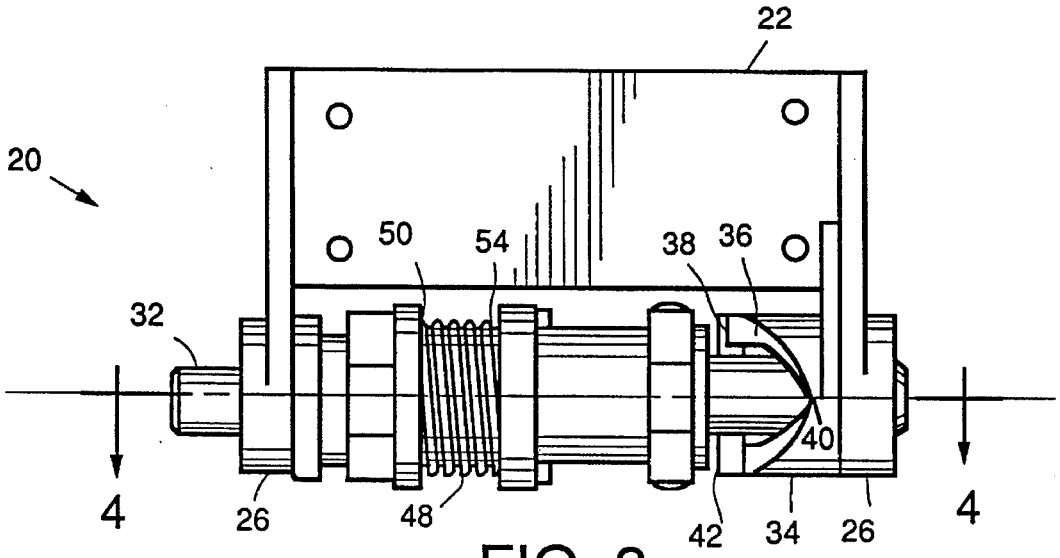
FIG. 3 is a plan view of a deployment hinge in the closed position.
Figure 4:
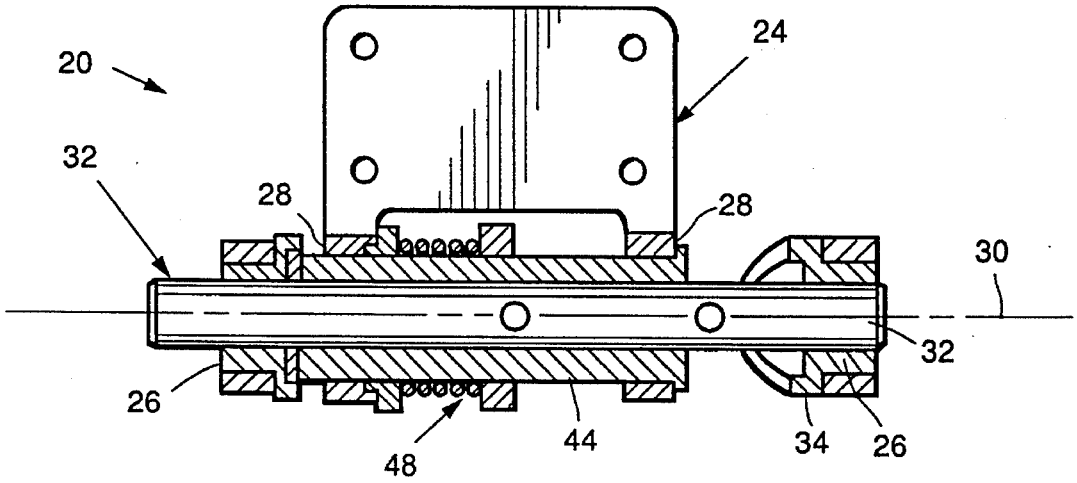
FIG. 4 is a sectional view of the hinge of FIG. 3, taken along line 4—4.

FIGS. 1–2 depict a deployment hinge 20 in an open position, and FIGS. 3–4 depict the same deployment hinge in a closed position. The deployment hinge 20 includes a first hinge plate 22 and a second hinge plate 24. The first hinge plate 22 has a first hinge pin receiver 26 fixed thereon, and the second hinge plate 24 has a second hinge pin receiver 28 fixed thereon. The hinge pin receivers 26 and 28 each comprise a pair of spaced-apart bushings aligned along a common axis. The first hinge pin receivers 26 are spaced apart more than the second hinge pin receivers 28, so that the second hinge pin receivers 28 of the second hinge plate 24 can be nested between the first hinge pin receivers 26 of the first hinge plate 22, aligned along a hinge pin axis 30.

A cylindrical hinge pin 32 is received within the first hinge pin receiver 26 and the second hinge pin receiver 28, with its cylindrical axis coincident with the hinge pin axis 30. The hinge pin 32 thereby links the first hinge plate 22 and the second hinge plate 24 in a manner that permits them to pivot about the hinge pin axis 30. The hinge pin 32 is longer than the maximum length of the first hinge pin receiver 26. The hinge pin 32 is free to move in a sliding manner within the hinge pin receivers 26 and 28 in a direction parallel to the hinge pin axis 30.

A cam 34 is supported on the first hinge plate 22. The cam 34 is preferably in the general form of a hollow cylinder or bushing whose cylindrical axis coincides with the hinge pin axis 30. The cam 34 is fixed to an inwardly facing side of one of the bushings of the first hinge pin receiver 26. The cam 34 has two helical cam surfaces 36 spaced 180 degrees apart from each other on the circumference of the generally cylindrical cam. The cam surfaces 36 define a pair of lobes 38 and a pair of recesses 40. The recesses 40 are of reduced height (i.e., further to the right in the view of FIG. 1) relative to the lobes 38 and are positioned around the circumference of the generally cylindrical cam at 90 degrees from the lobes 38.

A cam follower pin 42 extends radially outwardly from both sides of the cylindrical surface of the hinge pin 32, transversely to the hinge pin axis 80. The cam follower pin 42 is located axially along the length of the hinge pin 32 at a position such that it can ride on the cam surface 36 when the deployment hinge 20 is assembled.

A cylindrical bushing 44 overlies the hinge pin 32. The second hinge pin receivers 28 of the second hinge plate 24 are fixed to the bushing 44, so that it is the bushing 44 that supplies the support for the second hinge plate 24 on the hinge pin 32. The bushing 44 has a slot 46 therethrough that extends a portion of the length of the bushing. The long axis of the slot 46 is parallel to the hinge pin axis 30.

A coil spring 48 overlies the bushing 44, between the two ends of the second hinge pin receiver 28. A first end 50 of the coil spring 48 rests against one end of the second hinge pin receiver 28, and is thence fixed against movement parallel to the hinge pin axis 30 in the direction blocked by that portion of the second hinge pin receiver 28.

A spring driver pin 52 extends radially outwardly from both sides of the cylindrical surface of the hinge pin 32, transversely to the hinge pin axis 30. The spring driver pin 52 extends through the slot 46 of the bushing 44. The spring driver pin 52 is located axially along the length of the hinge pin 32 at a position such that it contacts a second end 54 of the coil spring 48 when the deployment hinge 20 is assembled.

The functioning of the deployment hinge 20 is next described. In the open, deployed position of FIGS. 1–2, the spring 48 reacts against the spring driver pin 52, forcing the hinge pin 32 to the right in the view of FIGS. 1–2. The spring 48 is in a relatively extended position. The cam follower pin 42 contacts the cam surface 36 at one of the recesses 40.

As the deployment hinge 20 is closed toward the stowed position, which may be viewed for illustration as the second hinge plate 24 pivoting about the hinge pin axis 30 to move upwardly from the plane of FIG. 1 to a position extending out the plane of FIG. 3, the cam follower pin 42 rides along the cam surface 36 with a helical motion toward the lobes 38. The hinge pin 32 is thereby forced to move to the left in the view of FIG. 3–4, compressing the coil spring 48 as a result of its reaction with the spring driver pin 52.

The structure attached to the second hinge plate 24 is normally latched in the closed position by a latch (not shown). The potential energy stored in the spring 48 later aids in deploying the second hinge plate 24 back to the open position. In each of the opening and closing movements, the hinge pin 32 rotates exactly one-quarter of a turn about the hinge pin axis 30, inasmuch as the spring driver pin 52 is captured in the slot 46 and is constrained to turn the same amount as the second hinge plate 24 is pivoted about the hinge pin axis 30.

In a deployment operation, the second hinge plate 24 is unlatched and released. The potential energy of the coil spring 48 is converted to the kinetic energy associated with the movement of the second hinge plate 24 and affixed deployable structure to the open or deployed position. The cam follower pin 42 moves from the lobe 38 with a helical motion toward the recess 40, such that the hinge pin 20 moves to the right in the view of FIGS. 1–4. The recess 40 is located at a selected angular position, here 90 degrees from the lobe so as to achieve a right angle deployment. When the cam follower pin 42 reaches the recess 40 position, it begins to move back up the cam surface 36 toward the opposing lobe 38. The kinetic energy of the overshoot past the desired deployment location is frictionally absorbed in a resilient manner rather than an abrupt stop, resulting in relatively gentle loading of the deployed structure and the hinge pin. The stored energy of the spring 48 eventually creates a restoring force and reversal of movement back toward the desired position. The energy is gradually dissipated by friction, so that after at most a few overshoot cycles the second hinge plate 24 and its supported deployed structure reach an equilibrium at the angular location associated with the position of the recess 40 of the cam 34.

If, in a deployed state, the deployed structure is displaced from the equilibrium position by an external force such as a vibration or the like, the external force is absorbed and a gentle restoring force back to equilibrium is created by the same mechanism just described. The deployed structure is thereby held in its proper location by the restoring force created by the deployment hinge 20.

In a preferred construction, the hinge plates 22 and 24 are made of aluminum alloy. The hinge pin 32, cain follower pin 42, spring driver pin 52, and assembly screws are made of corrosion-resistant steel. The cam 34, bushing 44, and bushing forming the second hinge pin receiver 28 are made of a polyimide with molybdenum disulfide added. This latter material is self-lubricated and provides dry lubrication during movement.

Figure 5:
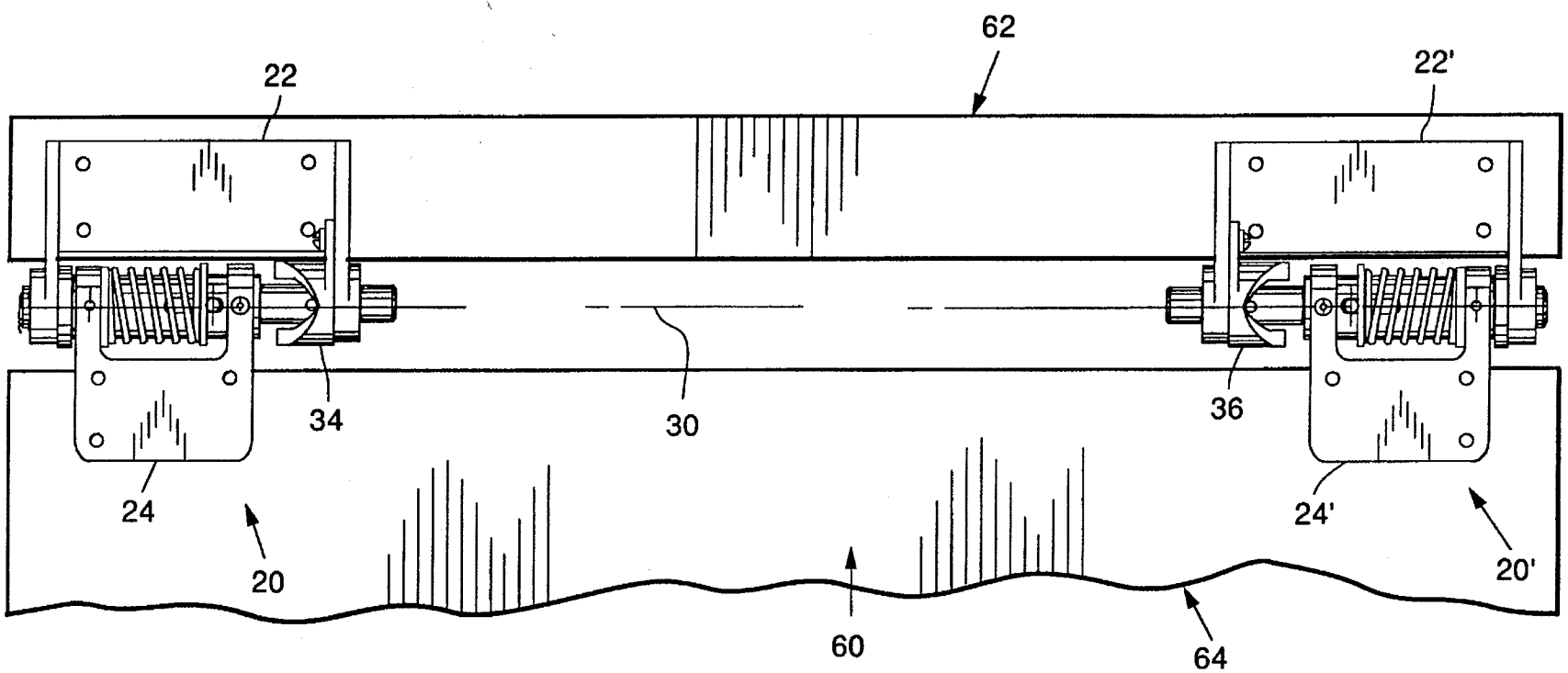
FIG. 5 is an elevational view of a pair of deployment hinges used to support a deployable piece.

As shown in FIG. 5, the deployment hinge 20 is preferably used in a hinge system 60, in combination with another deployment hinge 20' which is a mirror image of the deployment hinge 20 but is otherwise identical in construction. The first hinge plates 22 and 22' of the respective deployment hinges 20 and 20' are fixed to a stationary structure 62, and the second hinge plates 24 and 24' of the respective deployment hinges 20 and 20' are fixed to a deployable structure 64. The use of two deployment hinges 20 and 20' that are mirror images of each other cancels out the reaction forces of the springs, minimizing the frictional torque.

The preferred application of the present invention is in spacecraft where the deployment functions in a zero-gravity environment. In accordance with this aspect of the invention, a method for deploying a structure in a zero-gravity environment comprising the steps of providing a space vehicle having a fixed portion and a deployable portion, and joining the fixed portion to the deployable portion with a hinge system of the type described herein, in either its preferred or more general forms. The method further includes placing the deployable part in a stowed position and retaining the deployable part in the stowed position, and thereafter releasing the deployable part to move from the stowed position to an open position while the vehicle is in a zero-gravity environment.

Figure 6:
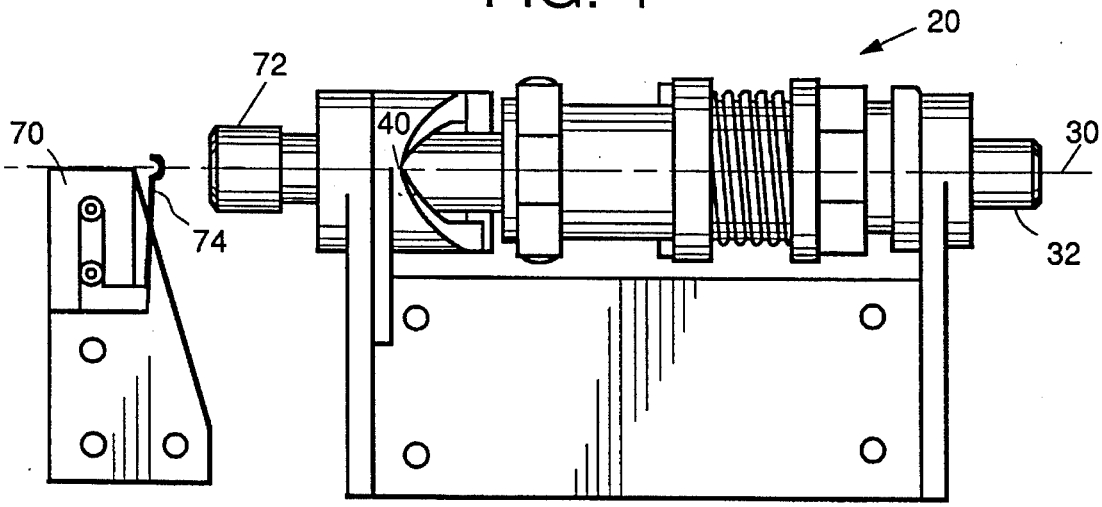
FIG. 6 is an elevational view of the deployment hinge with an associated telemetry switch.

In such space vehicles, it is often desirable to provide a sensor that produces telemetry data confirming the operation of mechanical devices such as the deployment hinge 20. The present invention is well suited for use with such a sensor 70, illustrated in FIG. 6 as a microswitch. The sensor 70 is mounted adjacent to the end of the deployment hinge 20, such that an extension 72 of the hinge pin 32 can contact an actuator arm 74 of the sensor 70 when the hinge pin 32 has moved to its position associated with opening of the deployment hinge (as in FIG. 1). In the illustrated configuration, when the deployment hinge 20 is in its closed position, the actuator arm 74 is not contacted. When the deployment hinge 20 moves to its open position, the hinge pin 32 moves to the left, the extension 72 contacts and moves the actuator arm 74 causing a switch in the sensor 70 to change position, and a telemetry signal indicating successful operation of the deployment hinge 20 is sent.

The present invention provides an advance in the art of mechanisms for use in deploying structures. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A hinge system comprising at least a first hinge having:

a first hinge plate having a first hinge plate hinge pin receiver thereon;

a second hinge plate having a second hinge plate hinge pin receiver thereon;

a cylindrical hinge pin extending between the first hinge plate hinge pin receiver and the second hinge plate hinge pin receiver to pivotably join the first hinge plate and the second hinge plate, the hinge pin having a hinge pin axis coincident with a cylindrical axis of the hinge pin and about which the second hinge plate is pivotable with respect to the first hinge plate, the hinge pin being free to move in a direction parallel to the hinge pin axis relative to the second hinge plate;

a cam fixed to the first hinge plate and having a cam surface thereon;

a cam follower pin attached to and extending outwardly from the hinge pin transversely to the hinge pin axis and disposed to ride on the cam surface;

a bushing fixed to the second hinge plate and overlying the hinge pin, the bushing having a slot therein extending parallel to the hinge pin axis;

a coil spring overlying the bushing and having a first end fixed with respect to movement parallel to the hinge pin axis;

a spring driver pin attached to and extending outwardly from the hinge pin transversely to the hinge pin axis and through the slot of the bushing, the spring driver pin being disposed to contact a second end of the spring.

2. The hinge system of claim 1, further including a second hinge having a structure identical to that of the first hinge.

3. The hinge system of claim 1, wherein the cam comprises a cylindrical cam bushing overlying the hinge pin and the cam surface comprises a shaped surface at one end of the cam bushing.

4. The hinge system of claim 3, wherein the cam follower pin extends outwardly from both oppositely sides of the hinge pin, and wherein the cam surface comprises two helical surfaces spaced 180 degrees apart around a circumference of the cam bushing, the cam surfaces defining a pair of lobes spaced 180 degrees apart from each other around the circumference of the cam bushing and a pair of recesses spaced at 90 degrees from the cam lobes around the circumference of the cam bushing.

5. The hinge system of claim 1, wherein the cam is made of a self-lubricated material.

6. The hinge system of claim 1, wherein the bushing is made of a self-lubricated material.

7. The hinge system of claim 1, wherein the first hinge plate hinge pin receiver and the second hinge plate hinge pin receiver are each made of a self-lubricated material.

8. The hinge system of claim 1, further including a telemetry switch having an activation arm disposed to engage the hinge pin upon compression of the spring.

9. A hinge system comprising at least a first hinge having:

a first hinge plate having a first hinge plate hinge pin receiver thereon, the first hinge plate hinge pin receiver comprising a first pair of spaced-apart bushings;

a second hinge plate having a second hinge plate hinge pin receiver thereon, the second hinge plate hinge pin receiver comprising a second pair of spaced-apart bushings, the first pair of spaced-apart bushing being spaced apart more than the second pair of spaced-apart bushings, so that the second pair of spaced apart bushings is nested between the first-pair of spaced-apart bushings along the hinge pin axis;

a cylindrical hinge pin engaging the first hinge plate hinge pin receiver bushings and the second hinge plate hinge pin receiver bushings to pivotably join the first hinge plate and the second hinge plate, the hinge pin having a hinge pin axis coincident with a cylindrical axis of the hinge pin and about which the second hinge plate is pivotable with respect to the first hinge plate, the hinge pin being free to move in a direction parallel to the hinge pin axis relative to the second hinge plate;

a coil spring overlying the hinge pin and lying between the second pair of spaced-apart bushings;

means for compressing the spring axially to store energy as the second hinge plate moves from an open position to a closed position and for releasing the stored energy as the second hinge plate moves from the closed position to the open position.

10. The hinge system of claim 9, further including a second hinge having a structure identical to that of the first hinge.

11. The hinge system of claim 9, wherein the means for compressing includes means for compressing the spring upon movement in either pivoting direction of the second hinge plate about the open position.

12. The hinge system of claim 11, wherein the means for compressing includes a cam and a cam follower.

13. A method for deploying a structure in a zero-gravity environment, comprising the steps of:

providing a hinge system for joining a fixed portion and a deployable portion of a space vehicle, the hinge system comprising a first hinge having:

a first hinge plate having a first hinge plate hinge pin receiver thereon, a second hinge plate having a second hinge plate hinge pin receiver thereon, a cylindrical hinge pin extending between the first hinge plate hinge pin receiver and the second hinge plate hinge pin receiver to pivotably join the first hinge plate and the second hinge plate, the hinge pin having a hinge pin axis coincident with a cylindrical axis of the hinge pin and about which the second hinge plate is pivotable with respect to the first hinge plate, the hinge pin being free to move in a direction parallel to the hinge pin axis relative to the second hinge plate, a cam fixed to the first hinge plate and having a cam surface thereon, a cam follower pin attached to and extending outwardly from the hinge pin transversely to the hinge pin axis and disposed to ride on the cam surface, a bushing fixed to the second hinge plate and overlying the hinge pin, the busing having a slot therein extending parallel to the hinge pin axis, a coil spring overlying the bushing and having a first end fixed with respect to movement parallel to the hinge pin axis, a spring driver pin attached to and extending outwardly from the hinge pin transversely to the hinge pin axis and through the slot of the bushing, the spring driver pin being disposed to contact a second end of the spring;

placing the deployable part in a stowed position and retaining the deployable part in the stowed position; and releasing the deployable part to move from the stowed position to an open position while the vehicle is in a zero-gravity environment.

* * * * *